US012448180B2

(12) United States Patent
Marchese

(10) Patent No.: US 12,448,180 B2
(45) Date of Patent: Oct. 21, 2025

(54) BEVERAGE POURER AND METHOD

(71) Applicant: Gerald J. Marchese, West Chicago, IL (US)

(72) Inventor: Gerald J. Marchese, West Chicago, IL (US)

( * ) Notice: Subject to any disclaimer, the term of this patent is extended or adjusted under 35 U.S.C. 154(b) by 369 days.

(21) Appl. No.: 18/109,098

(22) Filed: Feb. 13, 2023

(65) Prior Publication Data

US 2024/0270452 A1 Aug. 15, 2024

(51) Int. Cl.
*B65D 47/06* (2006.01)

(52) U.S. Cl.
CPC ..... *B65D 47/06* (2013.01)

(58) Field of Classification Search
CPC ..... B65D 23/065; B65D 47/40; B65D 23/06
USPC ..... 222/108
See application file for complete search history.

(56) References Cited

U.S. PATENT DOCUMENTS 4,155,212 A * 5/1979 Marchese ..... B65B 9/15 53/581
4,222,504 A * 9/1980 Ackerman ..... B65D 23/065 222/569
4,437,583 A * 3/1984 O'Connor ..... B65D 23/065 215/41
5,651,481 A * 7/1997 Jensen ..... B65D 23/065 222/569
6,228,459 B1 * 5/2001 Bujalski ..... B65D 23/065 428/80
6,325,247 B1 * 12/2001 Iggulden ..... B65D 41/62 428/40.1
6,352,179 B1 * 3/2002 Andersen ..... A47G 19/145 222/569
6,926,169 B2 * 8/2005 Burato ..... A47G 21/00 222/569
RE38,859 E * 11/2005 Jensen ..... B65D 47/06 222/569
8,485,503 B2 * 7/2013 Lei ..... B01F 23/23412 261/119.1
8,875,914 B2 * 11/2014 Marsollier ..... B65D 23/065 215/256
9,624,001 B1 * 4/2017 Hill ..... B65D 23/065
11,511,911 B1 * 11/2022 Woodhead ..... B65D 23/065
2001/0030208 A1 * 10/2001 Iggulden ..... B65D 23/065 428/354
2005/0023308 A1 * 2/2005 Burato ..... B65D 23/065 222/569

(Continued)

FOREIGN PATENT DOCUMENTS

WO WO-2006048673 A1 * 5/2006 ..... B65D 23/065
WO WO-2010100295 A1 * 9/2010 ..... B65D 23/065

(Continued)

*Primary Examiner* — Paul R Durand
*Assistant Examiner* — Michael J. Melaragno
(74) *Attorney, Agent, or Firm* — The Law Offices of Konrad Sherinian, LLC

(57) ABSTRACT

A non-drip beverage pourer in the form of a one-piece, round, elastically flexible sheet with an embossed pouring surface. When flexed (folded or rolled) to form the pouring surface into a "U" or tube shape, partially inserted through a pour opening and into a neck of a bottle, and released, the sheet passively conforms to the shape of the bottle opening to form a pour channel. Raised and recessed features on the pouring surface cause the beverage to be aerated when poured from the bottle through the pour channel.

12 Claims, 5 Drawing Sheets

(56) References Cited

U.S. PATENT DOCUMENTS

| | | | | |
|---|---|---|---|---|
| 2005/0258130 | A1* | 11/2005 | Fallaha | B65D 23/065 215/246 |
| 2008/0185360 | A1* | 8/2008 | Zak | B65D 23/065 215/392 |
| 2008/0314924 | A1* | 12/2008 | Marr | B65D 23/065 222/571 |
| 2010/0187256 | A1* | 7/2010 | Draisma | B65D 23/065 40/310 |
| 2012/0097633 | A1* | 4/2012 | Marsollier | B65D 41/62 215/277 |
| 2012/0261844 | A1* | 10/2012 | Lei | B01F 23/23412 261/119.1 |
| 2016/0236157 | A1* | 8/2016 | Casino | B01F 35/718051 |
| 2023/0039739 | A1* | 2/2023 | Samokhvalov | A47G 23/0241 |
| 2024/0270452 | A1* | 8/2024 | Marchese | B65D 47/40 |

FOREIGN PATENT DOCUMENTS

| | | | | |
|---|---|---|---|---|
| WO | WO-2013011424 | A2 * | 1/2013 | B65D 23/065 |
| WO | WO-2015185609 | A1 * | 12/2015 | B65D 23/065 |

* cited by examiner

BEVERAGE POURER AND METHOD

CROSS-REFERENCE

None.

FIELD OF THE DISCLOSURE

The present disclosure relates to non-drip beverage pourers. More particularly, it relates to a beverage pourer in the form of a one-piece, elastically flexible sheet member that can be rolled up and partially inserted into the neck of a beverage bottle, such as a wine bottle, to form a protruding pour channel.

SUMMARY

According to an aspect of the disclosure, a beverage pourer comprises an elastically flexible sheet. The sheet has a relaxed state in which the sheet is generally flat and has a top side facing in an upward vertical direction, a bottom side facing in a downward vertical direction opposite the upward vertical direction, at least one horizontal longitudinal dimension, and at least one horizontal transverse dimension, the transverse dimension being perpendicular to the longitudinal dimension. The sheet comprises an upper surface on the top side, a lower surface on the bottom side, a sheet thickness extending downward from the upper surface to the lower surface, and a peripheral edge circumscribing an area of the upper surface and an area of the lower surface. The upper surface includes upper surface raised regions and upper surface recessed regions, the upper surface raised regions extending above the upper surface recessed regions. The sheet is adapted and configured to be manually flexed transversely to impart concavity to the upper surface, the flexed sheet being manually insertable through a round pour opening of a beverage bottle in a longitudinal insertion direction. The sheet is biased, when so flexed, partially inserted into the beverage bottle, and released, to unflex transversely so as to conform to at least a portion of an inner perimeter of the round pour opening to form a pour channel extending through the pour opening. The pour channel thus formed comprises a distal portion of the upper surface extending longitudinally into the beverage bottle from the round pour opening to a distal end of the pour channel, and a proximal portion of the upper surface protruding longitudinally out of the beverage bottle from the round pour opening to a proximal end of the pour channel. The lower surface of the sheet thus partially inserted and released is adapted and configured so to engage an inner surface of the beverage bottle as to restrict the beverage from flowing between the sheet lower surface and the beverage bottle inner surface, thus to allow a beverage to be poured from the beverage bottle through the pour channel without the beverage leaking or dripping out of the bottle under the pour channel.

BRIEF DESCRIPTION OF THE DRAWINGS

Although the characteristic features of this disclosure will be particularly pointed out in the claims, the disclosed method and system, and how it may be made and used, may be better understood by referring to the following description taken in connection with the accompanying drawings forming a part hereof, wherein like reference numerals refer to like parts throughout the several views and in which:

A person of ordinary skill in the art will appreciate that elements of the figures above are illustrated for simplicity and clarity and are not necessarily drawn to scale. The dimensions of some elements in the figures may have been exaggerated relative to other elements to help to understand the present teachings. Furthermore, a particular order in which certain elements, parts, components, modules, steps, actions, events and/or processes are described or illustrated may not be required. A person of ordinary skill in the art will appreciate that, for simplicity and clarity of illustration, some commonly known and well-understood elements that are useful and/or necessary in a commercially feasible embodiment may not be depicted to provide a clear view of various embodiments per the present teachings.

DETAILED DESCRIPTION

In the following description of various examples of embodiments of the disclosed device and method, reference is made to the accompanying drawings, which form a part hereof, and in which are shown by way of illustration various example devices, systems, and environments in which aspects of the disclosed device and method can be practiced. Other specific arrangements of devices, systems, and environments, can be used, and structural modifications and functional modifications can be made without departing from the scope of the disclosed device and method.

Described in the present disclosure is a non-drip beverage pourer in the form of a thin, one-piece, round, elastically flexible sheet with at least one embossed pouring surface, an embodiment of which is illustrated in the accompanying drawing figures. As is commonly known, attempting to pour wine or other beverage directly from a glass bottle into a serving glass often results in drops of beverage forming at the pouring rim, particularly at the end of a pour when a server tips the bottle back to a vertical position from a tilted pouring angle. Such drops often adhere to and run down the outside of the bottle or drip from the rim at a steep angle that suddenly varies from that of a full pouring stream, in both cases missing an intended serving glass, going to waste, and potentially soiling a tablecloth or table surface. The disclosed pourer is said to be "non-drip" in that it prevents such dripping without the need for the technique of twisting the bottle at the end of a pour. In addition, the disclosed pourer is compact, being in the form of a generally flat, thin sheet when in a relaxed state between uses, and further promotes aeration, having an embossed pouring surface on one or both sides of the sheet, which tend to produce turbulent pouring flow.

Figure 1:
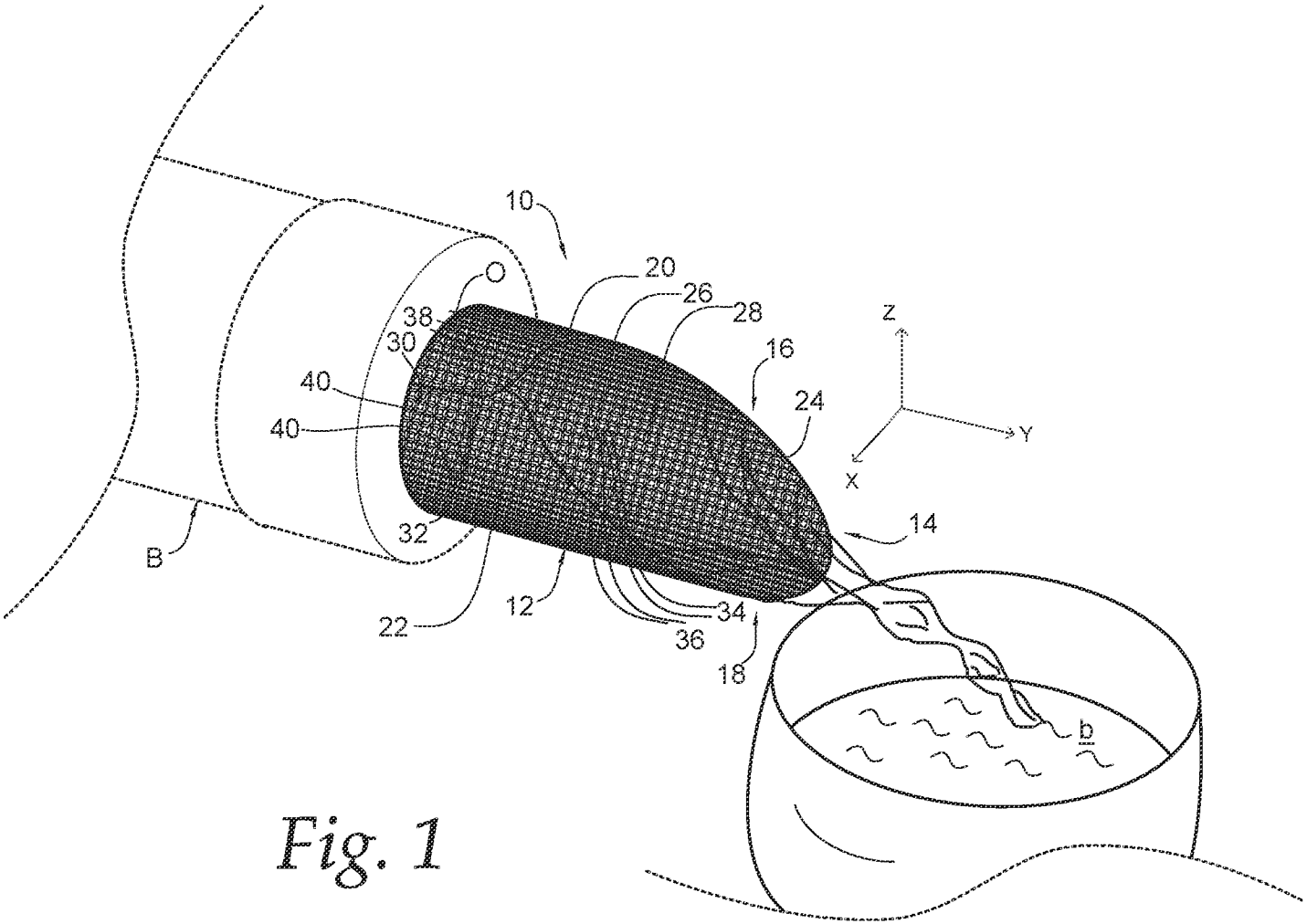
FIG. 1 is a perspective view of a beverage pourer in a rolled-up configuration, partially inserted into a wine bottle according to an illustrated use embodiment.

With reference to the drawing views of FIGS. 1-5, a beverage pourer 10 comprises an elastically flexible sheet 12. The sheet 12 can be folded or rolled to a "U" or tube-shaped flexed state and partially inserted through a round pour opening O of a beverage bottle B, as illustrated in FIG. 1, to form a pour channel 14 for pouring a beverage b from the beverage bottle B. In a relaxed state, the sheet 12 is generally flat as illustrated in FIGS. 2-5. The sheet 12 in the relaxed state has a top side 16 facing in an upward vertical (positive z) direction, a bottom side 18 facing in a downward vertical (negative z) direction opposite the upward vertical direction, at least one horizontal longitudinal dimension, and at least one horizontal transverse dimension, the transverse dimension being perpendicular to the longitudinal dimension. Generally, the longitudinal dimension of the sheet 12 can be any linear dimension in the horizontal (x-y) plane. As illustrated, the longitudinal dimension is the y dimension, and the transverse dimension is the x dimension.

The sheet 12 comprising an upper surface 20 on the top side 16, a lower surface 22 on the bottom side 18, a sheet thickness t extending downward from the upper surface 20 to the lower surface 22, and a peripheral edge 24 circumscribing an area of the upper surface 20 and of the lower surface 22, which areas are essentially coextensive. By the sheet 12 being said to be "generally flat," it will be understood that the upper surface 20 deviates no more than minimally from an upper tangent plane Pu, and the lower surface 22 deviates no more than minimally from a lower tangent plane Pl, each over its entire respective area, as described in more detail below.

The upper surface 20 has upper surface raised regions 26 and upper surface recessed regions 28, the upper surface raised regions 26 extending above the upper surface recessed regions 28. In addition, the lower surface 22 has lower surface raised regions 30 and lower surface recessed regions 32, the lower surface raised regions 30 extending below the lower surface recessed regions 32. The lower surface raised regions 30 are disposed opposite (that is, directly below) the upper surface recessed regions 28, and the lower surface recessed regions 32 are disposed opposite the upper surface raised regions 26. The upper and lower surfaces 20, 22 are said to be "embossed" with these raised and recessed regions 26-32. "Edges" and "vertices" where these regions meet, in the embodiment shown in FIGS. 1-5 as well as in the embodiments of different embossed patterns of the pourer 10' and the pourer 10" illustrated in FIGS. 6 and 7, respectively, may be depicted as sharp lines and points for ease of illustration, but they will be understood to be generally more rounded in practice.

Figure 2:
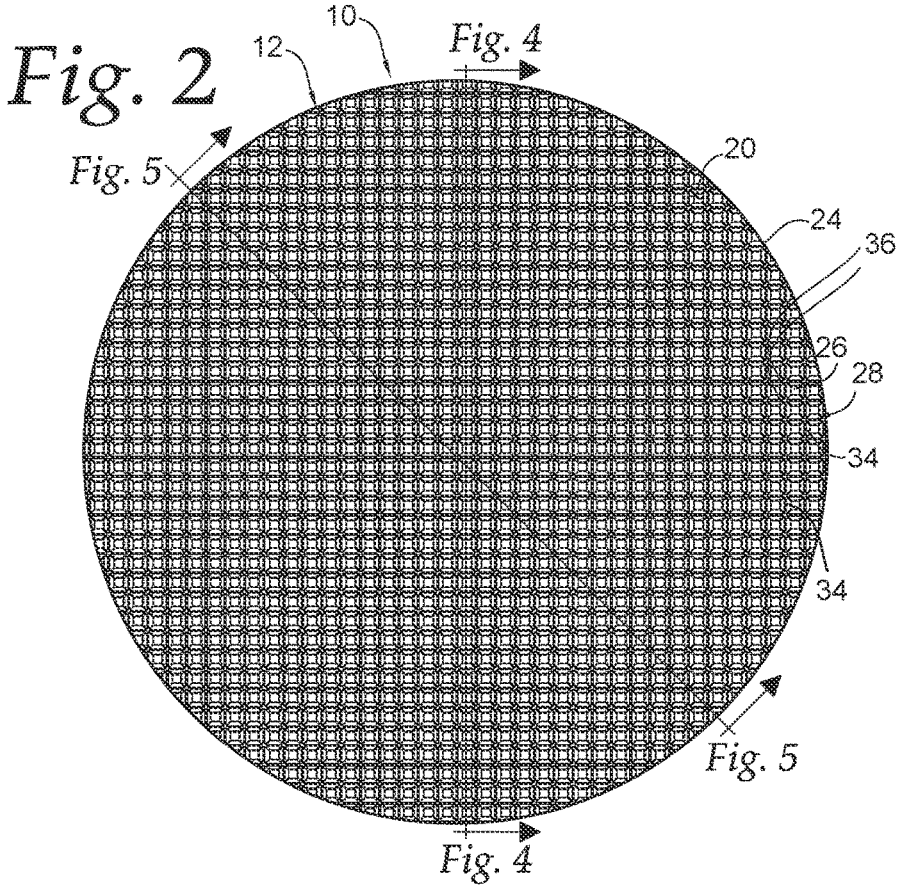
FIG. 2 is a top plan view of the beverage pourer of FIG. 1 in a flat configuration.
Figure 3:
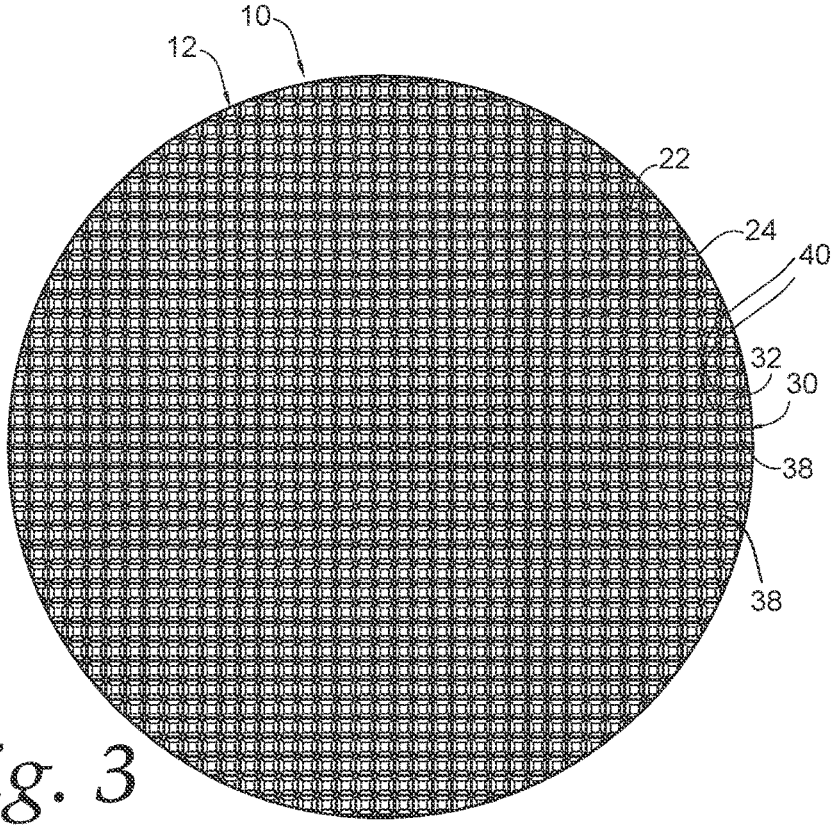
FIG. 3 is a bottom plan view of the beverage pourer of FIG. 1 in the flat configuration.
Figure 4:
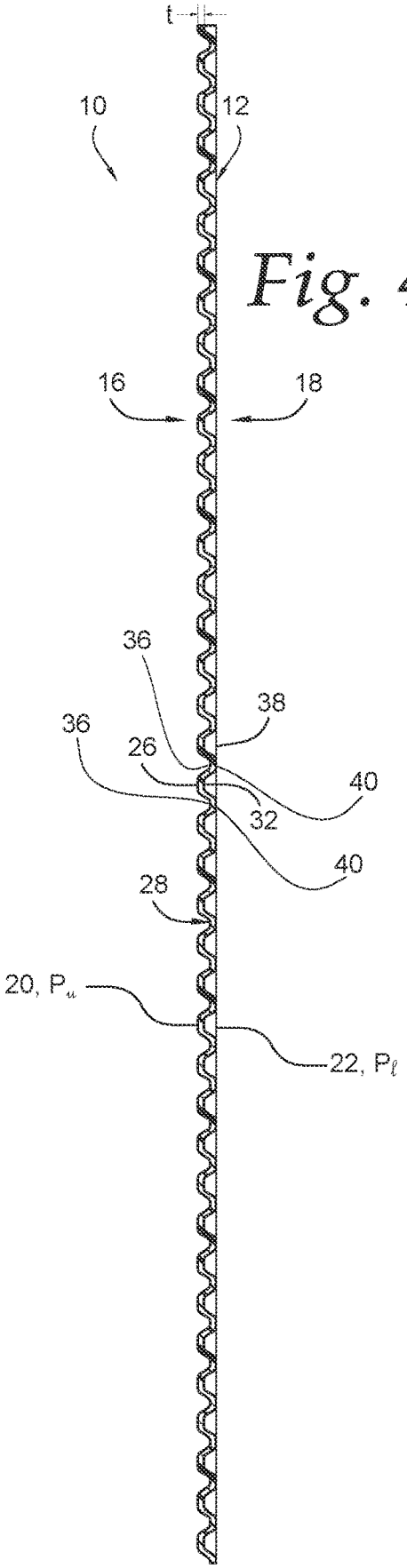
FIG. 4 is a cross-sectional elevation view of the beverage pourer of FIG. 1 cut along a first diameter.
Figure 5:
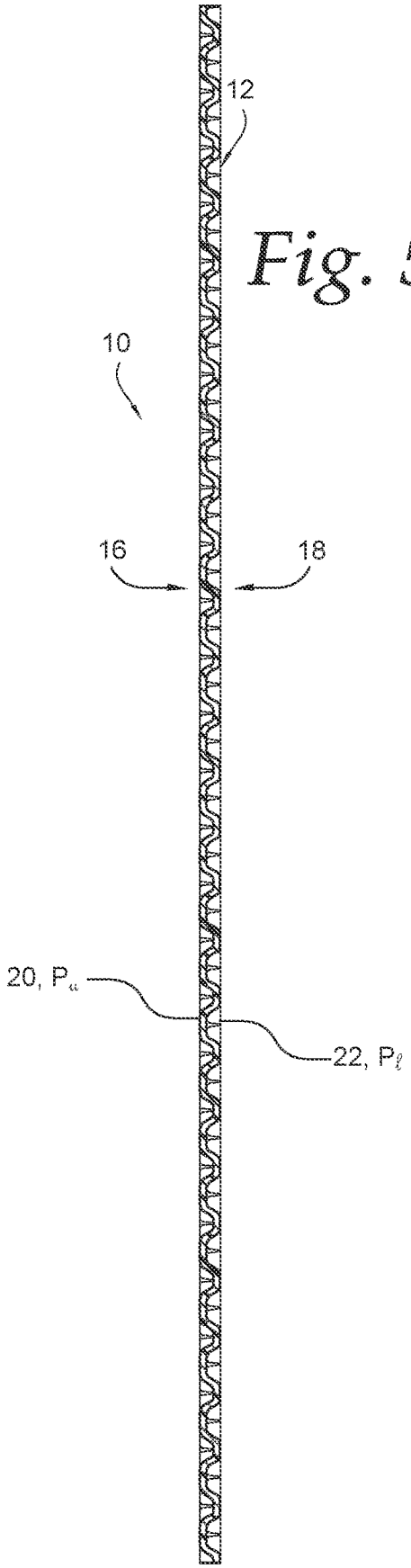
FIG. 5 is a cross-sectional elevation view of the beverage pourer cut along a second diameter offset forty-five degrees from the first diameter.

More particularly, the upper surface recessed regions 28 comprise a lattice of grooves, the lattice of grooves including a first set of parallel grooves 34 and a second set of parallel grooves 36, the first grooves 34 intersecting the second grooves 36, each upper surface raised region 26 being disposed between a neighboring pair of the first grooves 34 and between a neighboring pair of the second grooves 36, as best seen in FIG. 2. Still more particularly, the first grooves 34 are perpendicular to the second grooves 36, the upper surface raised regions 26 being generally in the form of square humps. Conversely, the lower surface raised regions 30 comprise a lattice of ridges, the lattice of ridges including a first set of parallel ridges 38 and a second set of parallel ridges 40, the first ridges 38 intersecting the second ridges 40, each lower surface recessed region 32 being disposed between a neighboring pair of the first ridges 38 and between a neighboring pair of the second ridges 40.

A depth of each groove of the first grooves 34 and the second grooves 36 is a vertical distance from an uppermost extent of a raised region 26 that is adjacent the groove 34, 36 to a lowermost extent of the groove 34, 36. In embodiments, a maximum depth of the grooves 34, 36 can for example, be about 0.010 inch or less, about 0.0075 inch or less, or even about 0.0050 inch or less. Similarly, a height of each ridge of the first ridges 38 and the second ridges 40 is a vertical distance from an uppermost extent of a lower surface recessed region 32 that is adjacent the ridge 38, 40 to a lowermost extent of the ridge 38, 40. In embodiments, the heights of the ridges 38, 40 are the same as the depths of the oppositely disposed grooves 34, 36. A thickness of the sheet t can be, for example, from about 0.00781 (about 0.2 mm) inch to about 0.0625 inch (about 1.60 mm). It will be understood that shallower grooves 34, 36 and a thinner sheet thickness t are generally desirable for compactness, and at least the latter for reduced manufacturing cost. On the other hand, deeper grooves 34, 36 may improve aeration, and a thicker sheet thickness t may improve the strength or durability of the sheet 12.

Figure 6:
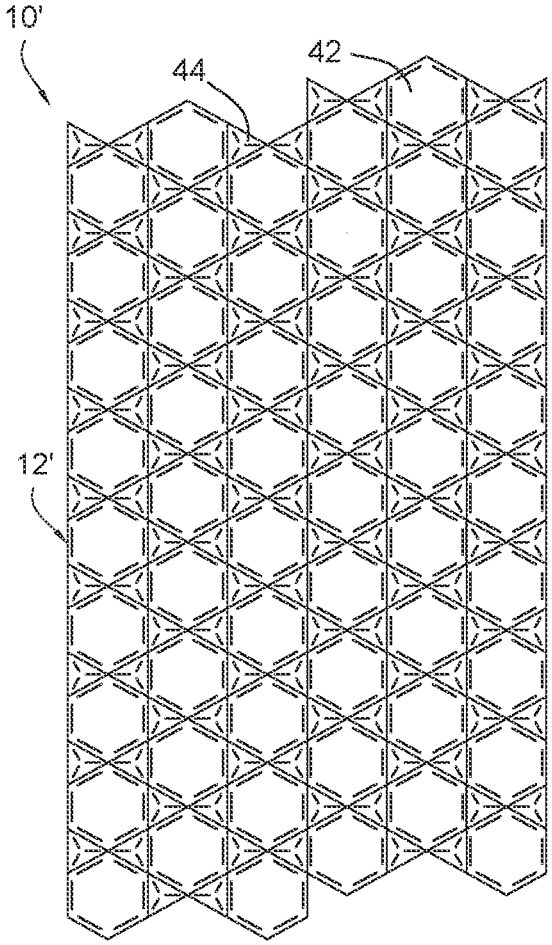
FIG. 6 is a top plan view of an embossing pattern of a beverage pourer according to another embodiment.

In another embodiment illustrated in FIG. 6, a beverage pourer 10' comprises a sheet 12' with a different pattern of raised and recessed regions. Shown in FIG. 6 is a truncated portion of an upper surface of the sheet 12', which includes recessed hexagonal regions 42 and raised triangular regions 44 in a tessellated pattern, which is commonly referred to as a "hexpin" pattern. The sheet 12' has a substantially uniform thickness, so that on its lower surface, the hexagonal regions 42 are raised and the triangular regions 44 are recessed. In other embodiments, a beverage pourer may comprise a sheet having still other different patterns of raised and recessed regions on an upper and lower surface.

Figure 7:
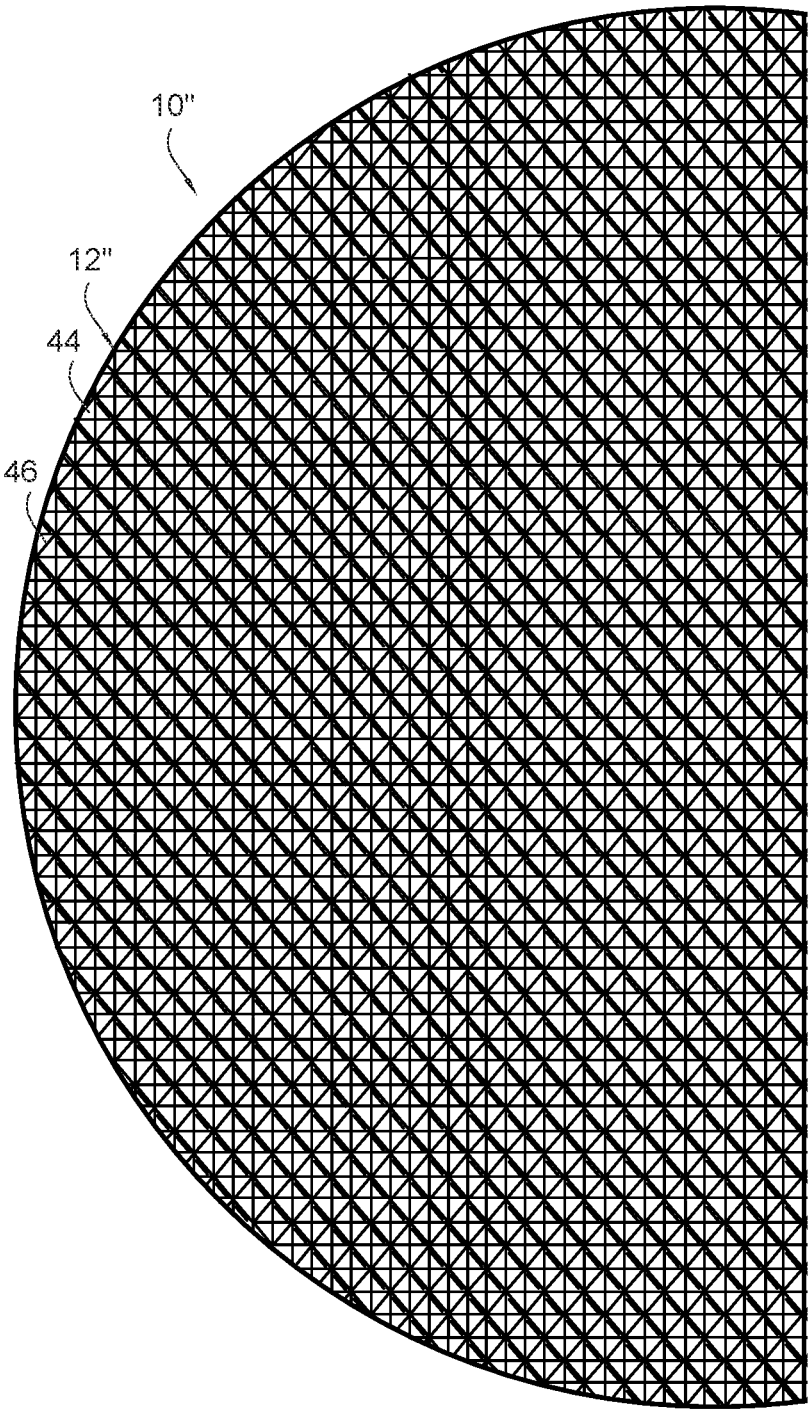
FIG. 7 is a top plan view of an embossing pattern of a beverage pourer according to another embodiment.

In another embodiment illustrated in FIG. 7, a beverage pourer 10" comprises a sheet 12" with a different pattern of raised and recessed regions. Shown in FIG. 7 is a truncated portion of an upper surface of the sheet 12", which includes raised diamond-shaped regions 46 in a tessellated pattern, having a lattice of recessed grooves 48 running between them. Each diamond-shaped region 46 generally resembles the top side of a square pyramid, having four generally triangular faces that incline toward a central point. The sheet 12" has a substantially uniform thickness, so that on its lower surface, the area opposite each diamond-shaped region 46 is recessed and the area opposite each groove 48 is raised (i.e., to form a ridge). In other embodiments, a beverage pourer may comprise a sheet having still other different patterns of raised and recessed regions on an upper and lower surface.

The sheet 12 is adapted and configured to be manually flexed transversely to impart concavity to the upper surface 20, the flexed sheet 12 being manually insertable through the round pour opening O of the beverage bottle B in a longitudinal (y) insertion direction. The sheet 12 is biased, when so flexed, partially inserted into the beverage bottle, and released, to unflex transversely so as to conform to at least a portion of an inner perimeter of the round pour opening O to form a pour channel 14 extending through the pour opening O, the pour channel 14 comprising a distal portion of the upper surface 20 that extends longitudinally into the beverage bottle B from the round pour opening O to a distal end of the pour channel 14, and a proximal portion of the upper surface 20 that protrudes longitudinally out of the beverage bottle B from the round pour opening O to a proximal end of the pour channel 14. The lower surface 22 of the sheet, thus partially inserted and released, is adapted and configured to engage an inner surface of the beverage bottle B in such a manner as to restrict the beverage b from flowing between the sheet lower surface 22 and the inner surface of the beverage bottle B, to allow the beverage b to be poured from the beverage bottle B through the pour channel 14 without the beverage b leaking or dripping out of the bottle under the pour channel 14.

The peripheral edge 24 of sheet 12 is preferably round, and still more preferably circular. This guarantees that the pour channel 14 will taper inwardly toward its bottom and toward its proximal end, thus providing a visual indicator of a pouring direction.

The sheet 12 is made of a food-safe polymer material. In an embodiment, it is made of polyethylene terephthalate (PET). In particular, the sheet 12 is made by embossing a film in a desired pattern and die-cutting the film to a desired shape, such as a preferred round, or more particularly circular, shape. For example, the sheet 12 can be die-cut to a three-inch diameter circular shape. A plurality of the sheets 12 may be then packaged together, such as in a plastic bag.

In a method according to the disclosure, as illustrated in FIG. 1, the beverage pourer 10 is used to pour the beverage b from the beverage bottle B. First, a user manually flexes the sheet 12 transversely (e.g., by folding or rolling) to impart concavity to the upper surface 20 and then partially inserts the flexed sheet 12 through the round pour opening O of the beverage bottle B in a longitudinal (negative y) insertion direction. The user then releases the flexed and partially inserted sheet 12, which, when released, unflexes transversely to conform to at least a portion of an inner perimeter of the round pour opening O, so as to form the pour channel 14. The user then pours the beverage b by tipping the bottle B from an upright orientation toward the proximal end of the pour channel 14 (as indicated visually by the taper of the pour channel 14, as explained above) so that the beverage b is poured from the bottle B through the pour channel 14 (into a serving container, such as the illustrated wine glass), without the beverage b leaking or dripping out of the bottle B under the pour channel 14. After so pouring the beverage b, the user tips the bottle B back upright without the beverage running down and/or dripping from an outer surface of the bottle B, and without the user needing to twist the bottle B about the pour opening O in order to avoid such spillage. More particularly, in the illustrated embodiment, the method is performed using a pourer 10 comprising a sheet 12 that is sized so that opposite transverse portions of the sheet 12 overlap when the flexed sheet 12 is partially inserted into the neck of the bottle B and released, as shown in FIG. 1. In this manner, at least a portion of the length of the pour channel conforms to and overlaps an entire inner perimeter of the pour opening O. In other embodiments, the sheet 12 spans more than half but less than the entirety of the inner perimeter of a pour opening, such as more than a one-hundred-eighty degree arc of a circular pour opening. Put another way, the sheet 12 has a sufficient transverse width to spans and overlap a major diameter (i.e., a largest inner dimension) of the pour opening when conforming to its inner perimeter. In embodiments, the sheet 12 is circular and has a diameter of approximately three inches, but a sheet according to this disclosure can have a larger or smaller diameter.

The preceding description of the disclosure has been presented for purposes of illustration and description and is not intended to be exhaustive or to limit the disclosure to the precise form disclosed. The description was selected to best explain the principles of the present teachings and the practical application of these principles to enable others skilled in the art to best utilize the disclosure in various embodiments and various modifications as are suited to the particular use contemplated. It should be recognized that the words "a" or "an" are intended to include both the singular and the plural. Conversely, any reference to plural elements shall, where appropriate, include the singular.

It is intended that the scope of the disclosure not be limited by the specification but be defined by the claim(s) set forth below. In addition, although narrow claims may be presented below, it should be recognized that the scope of this disclosure is much broader than presented by the claim(s). It is intended that broader claims will be submitted in one or more applications that claim the benefit of priority from this application. Insofar as the description above and the accompanying drawings disclose additional subject matter that is not within the scope of the claim or claims below, the additional disclosures are not dedicated to the public and the right to file one or more applications to claim such additional disclosures is reserved.

What is claimed is:

1. A beverage pourer comprising an elastically flexible sheet, the sheet having a relaxed state in which the sheet is generally flat, the sheet in the relaxed state having a top side facing in an upward vertical direction, a bottom side facing in a downward vertical direction opposite the upward vertical direction, at least one horizontal longitudinal dimension, and at least one horizontal transverse dimension, the transverse dimension being perpendicular to the longitudinal dimension;

the sheet comprising an upper surface on the top side, a lower surface on the bottom side, a sheet thickness extending downward from the upper surface to the lower surface, and a peripheral edge circumscribing an area of the upper surface and an area of the lower surface;

the upper surface of the sheet having upper surface raised regions and upper surface recessed regions, the upper surface raised regions extending above the upper surface recessed regions;

the lower surface of the sheet having lower surface raised regions and lower surface recessed regions, the lower surface raised regions being disposed opposite the upper surface recessed regions, the lower surface recessed regions being disposed opposite the upper surface raised regions, the lower surface raised regions extending below the lower surface recessed regions;

the sheet being adapted and configured to be manually flexed transversely to impart concavity to the upper surface, the flexed sheet being manually insertable through a round pour opening of a beverage bottle in a longitudinal insertion direction, the sheet being biased, when so flexed, partially inserted into the beverage bottle, and released, to unflex transversely so as to conform to at least a portion of an inner perimeter of the round pour opening to form a pour channel extending through the pour opening, the pour channel comprising a distal portion of the upper surface extending longitudinally into the beverage bottle from the round pour opening to a distal end of the pour channel, and a proximal portion of the upper surface protruding longitudinally out of the beverage bottle from the round pour opening to a proximal end of the pour channel, the lower surface of the sheet thus partially inserted and released being adapted and configured so to engage an inner surface of the beverage bottle as to restrict the beverage from flowing between the sheet lower surface and the beverage bottle inner surface, to allow a beverage to be poured from the beverage bottle through the pour channel without the beverage leaking out of the bottle under the pour channel.

2. The beverage pourer of claim 1 wherein the peripheral edge is round.

3. The beverage pourer of claim 2 wherein the peripheral edge is circular.

4. The beverage pourer of claim 1 wherein the upper surface recessed regions comprise a lattice of grooves, the lattice of grooves including a first set of parallel grooves and a second set of parallel grooves, the first grooves intersecting the second grooves, each upper surface raised region being disposed between a neighboring pair of the first grooves and between a neighboring pair of the second grooves.

5. The beverage pourer of claim 4 wherein the first grooves are perpendicular to the second grooves, the upper surface raised regions being generally square humps.

6. The beverage pourer of claim 4 wherein the lower surface raised regions comprise a lattice of ridges, the lattice of ridges including a first set of parallel ridges and a second set of parallel ridges, the first ridges intersecting the second ridges, each lower surface recessed region being disposed between a neighboring pair of the first ridges and between a neighboring pair of the second ridges.

7. The beverage pourer of claim 4 wherein a depth of each groove of the first grooves and the second grooves is a vertical distance from an uppermost extent of a raised region adjacent the groove to a lowermost extent of the groove, the depths of the grooves including no greater depth than 0.0625 inch.

8. The beverage pourer of claim 1 wherein the sheet thickness is from about 0.00781 inch to about 0.0625 inch.

9. The beverage pourer of claim 1 wherein the sheet is of one-piece construction.

10. The beverage pourer of claim 1 wherein the sheet is made of a food-safe polymer material.

11. The beverage pourer of claim 10 wherein the sheet is made of polyethylene terephthalate.

12. The beverage pourer of claim 1 wherein the sheet is made by embossing a film material to form said upper surface raised regions, said upper surface recessed regions, said lower surface raised regions, and said lower surface recessed regions and die-cutting the embossed film to form a shape of the peripheral edge.

* * * * *